US010545432B2

(12) United States Patent
Tsuda et al.

(10) Patent No.: US 10,545,432 B2
(45) Date of Patent: Jan. 28, 2020

(54) FEEDING SCREW AND DEVELOPING DEVICE

(71) Applicant: CANON KABUSHIKI KAISHA, Tokyo (JP)

(72) Inventors: Shunsuke Tsuda, Tokyo (JP); Osamu Ariizumi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/982,028

(22) Filed: May 17, 2018

(65) Prior Publication Data

US 2018/0335723 A1 Nov. 22, 2018

(30) Foreign Application Priority Data

May 22, 2017 (JP) ..... 2017-100860

(51) Int. Cl.
*G03G 15/08* (2006.01)

(52) U.S. Cl.
CPC ..... *G03G 15/0891* (2013.01); *G03G 15/0877* (2013.01); *G03G 15/0889* (2013.01); *G03G 15/0893* (2013.01); *G03G 2215/0819* (2013.01); *G03G 2215/0822* (2013.01); *G03G 2215/0827* (2013.01); *G03G 2215/0838* (2013.01)

(58) Field of Classification Search
CPC ..... G03G 15/0891; G03G 15/0877; G03G 2215/083; G03G 2215/0822; G03G 2215/0827; G03G 15/0865; G03G 15/0808; G03G 15/163; G03G 2221/1657; G03G 21/1647; G03G 15/0887; G03G 15/0889;
(Continued)

(56) References Cited

U.S. PATENT DOCUMENTS 10,409,198 B2 * 9/2019 Shirayanagi ..... G03G 15/0891
2007/0041748 A1 * 2/2007 Ikeda ..... G03G 21/10 399/253

(Continued)

FOREIGN PATENT DOCUMENTS

JP H09-120201 A 5/1997
JP 2010-256429 A 11/2010

OTHER PUBLICATIONS

European Search Report dated Nov. 21, 2018, in related European Patent Application No. 18171996.4.

(Continued)

*Primary Examiner* — David M. Gray
*Assistant Examiner* — Laura Roth
(74) *Attorney, Agent, or Firm* — Venable LLP

(57) ABSTRACT

A feeding screw for feeding a developer includes a rotation shaft, and first, second, and third blade portions helically formed on the outer peripheral surface of the rotation shaft to feed the developer in one direction. The first blade portion and the second blade portion overlap with each other, the second blade portion and the third blade portion do not overlap with each other, and the third blade portion and the first blade portion overlap with each other, all with respect to the rotational axis direction of the feeding screw. A gap is provided between a downstream end of the second blade and an upstream end of the third blade portion in the one direction, and the gap is disposed within a region where the first blade portion is formed with respect to the rotational axis direction of the feeding screw.

15 Claims, 10 Drawing Sheets

(58) Field of Classification Search
CPC ..... G03G 15/0893; G03G 2215/0819; G03G 2215/0838; G03G 15/0812
See application file for complete search history.

(56) References Cited

U.S. PATENT DOCUMENTS

| | | | | |
|---|---|---|---|---|
| 2014/0193176 | A1 | 7/2014 | Nakajima et al. | |
| 2014/0212179 | A1* | 7/2014 | Okuno | G03G 15/0893 399/254 |
| 2014/0235415 | A1* | 8/2014 | Nakajima | F16C 13/00 492/35 |
| 2014/0294446 | A1* | 10/2014 | Sako | G03G 15/0891 399/255 |
| 2017/0255125 | A1 | 9/2017 | Ariizumi | |
| 2017/0255129 | A1* | 9/2017 | Suzuki | G03G 15/0891 |
| 2017/0269505 | A1 | 9/2017 | Ariizumi et al. | |
| 2017/0308005 | A1 | 10/2017 | Ariizumi | |
| 2018/0017895 | A1 | 1/2018 | Ariizumi | |
| 2018/0129149 | A1* | 5/2018 | Yamaguchi | G03G 15/0812 |

OTHER PUBLICATIONS

Osamu Ariizumi et al., U.S. Appl. No. 15/982,023, filed May 17, 2018.
Osamu Ariizumi et al., U.S. Appl. No. 15/982,053, filed May 17, 2018.

* cited by examiner

FEEDING SCREW AND DEVELOPING DEVICE

FIELD OF THE INVENTION AND RELATED ART

The present invention relates to a feeding screw including blades with a plurality of threads and relates to a developing device including the feeding screw.

In an image forming apparatus using an electrophotographic type, an electrostatic latent image formed on a photosensitive drum is developed as a toner image by a developing device. As the developing device, a developing device using a two-component developer containing toner and a carrier has been conventionally used. In the case of the developing device using the two-component developer, the developer accommodated in a developing container is fed by a screw while being stirred by the screw.

As the screw for feeding the developer while stirring the developer, a constitution in which two blades each helically formed with a single thread around a rotation shaft are provided and each of the two blades (two threads) is provided with a discontinuous portion where the blade (thread) is discontinuous in an axial direction of the rotation shaft has been proposed (Japanese Laid-Open Patent Application (JP-A) 2010-256429).

As disclosed in JP-A 2010-256429, in the case where each of the two blades (two threads) is provided with the discontinuous portion, there is a possibility that a feeding property of the developer cannot be sufficiently ensured. That is, when the blade includes the discontinuous portion, an area of the blade contributing to feeding of the developer decreases, and therefore, the feeding property of the developer lowers. In the case of the constitution disclosed in JP-A 2010-256429, each of the blades similarly lowers in developer feeding property, and therefore, there is a possibility that the developer feeding property of the screw cannot be sufficiently ensured.

SUMMARY OF THE INVENTION

A principal object of the present invention is to provide a feeding screw and a developing device which are capable of compatibly realizing ensuring of a developer feeding property and a developer stirring property.

According to an aspect of the present invention, there is provided a feeding screw for feeding a developer comprising: a rotation shaft; a first blade helically formed with a single thread on the rotation shaft; a second blade helically formed with a single thread on the rotation shaft; and a third blade helically formed with a single thread on the rotation shaft, wherein with respect to a direction along the rotation shaft, a gap is provided between a downstream end portion of the second blade and an upstream end portion of the third blade, and wherein the gap is disposed corresponding to a region where the first blade is continuously formed.

According to another aspect of the present invention, there is provided a developing device comprising: (i) a developer carrying member configured to carry a developer containing toner and a carrier; (ii) a first chamber configured to accommodate the developer supplied to the developer carrying member; (iii) a second chamber configured to accommodate the developer for being circulated between itself and the first chamber; and (iv) a developing screw provided in the second chamber and configured to feed the developer, wherein the developing screw includes, (iv-i) a rotation shaft, (iv-ii) a first blade helically formed with a single thread on the rotation shaft, (iv-iii) a second blade helically formed with a single thread on the rotation shaft, and (iv-iv) a third blade helically formed with a single thread on the rotation shaft, wherein with respect to a developer feeding direction of the developing screw, a gap is provided between a downstream end portion of the second blade and an upstream end portion of the third blade, and wherein the gap is disposed corresponding to a region where the first blade is continuously formed.

According to another aspect of the present invention, there is provided a feeding screw for feeding a developer comprising: a rotation shaft; and a helical blade provided on the rotation shaft and including a plurality of threads, wherein the helical blade includes, a first blade helically formed with a single thread on the rotation shaft, and a second blade including a discontinuous region and helically formed with a single thread on the rotation shaft, wherein the discontinuous region of the second blade is provided so as to oppose the first blade.

According to a further aspect of the present invention, there is provided a developing device comprising: a developer carrying member configured to carry a developer containing toner and a carrier; a first chamber configured to accommodate the developer supplied to the developer carrying member; a second chamber configured to accommodate the developer for being circulated between itself and the first chamber; and a developing screw provided in the second chamber and configured to feed the developer, wherein the developing screw includes, a rotation shaft; and a helical blade provided on the rotation shaft and including a plurality of threads, wherein the helical blade includes, a first blade helically formed with a single thread on the rotation shaft, and a second blade including a discontinuous region and helically formed with a single thread on the rotation shaft, wherein the discontinuous region of the second blade is provided so as to oppose the first blade.

Further features of the present invention will become apparent from the following description of exemplary embodiments with reference to the attached drawings.

DESCRIPTION OF EMBODIMENTS

First Embodiment

Figure 1:
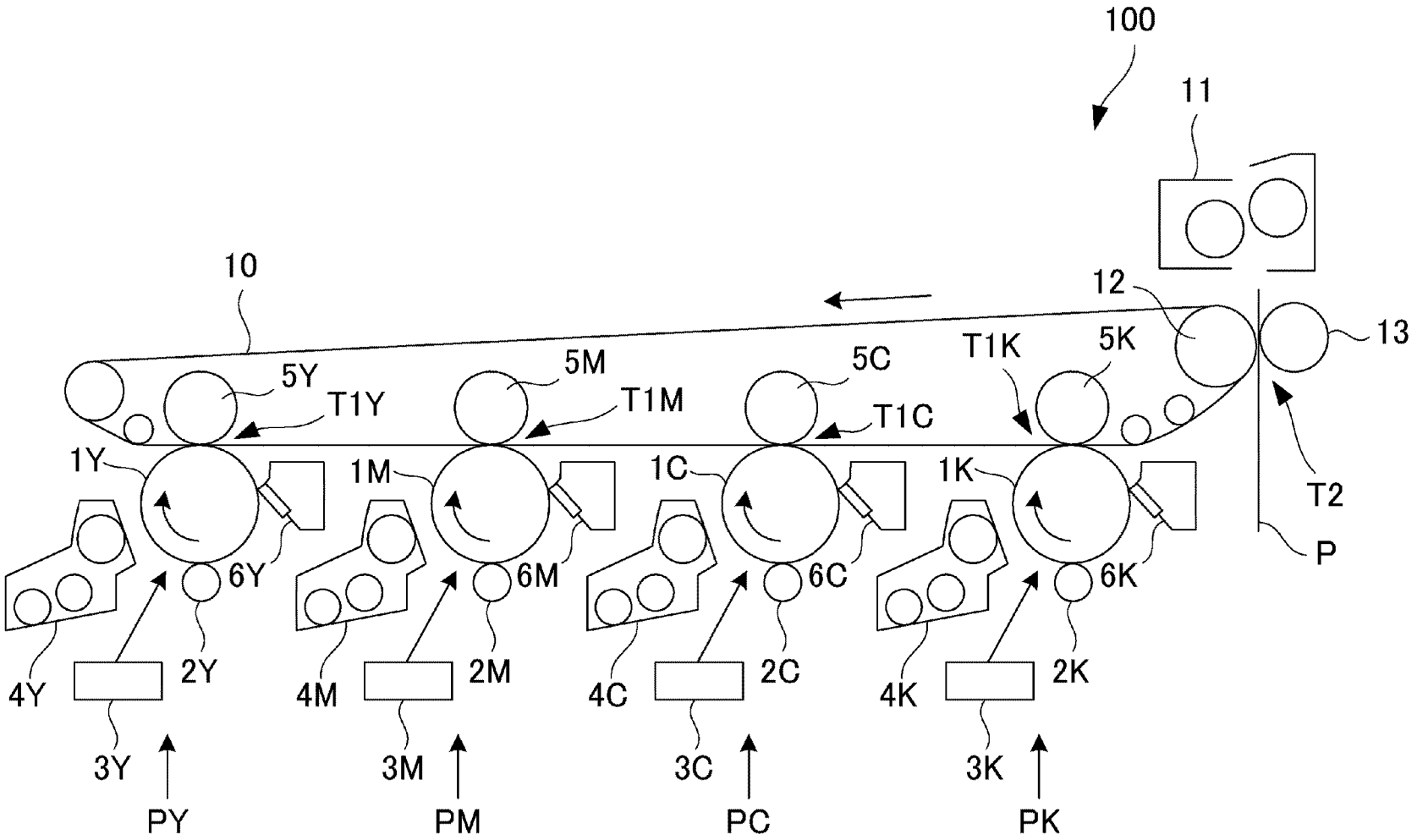
FIG. 1 is a schematic view of an image forming apparatus in a First Embodiment.

The First Embodiment will be described with reference to FIGS. 1 to 11. First, a general structure of an image forming apparatus in this embodiment will be described using FIG. 1.

[Image Forming Apparatus]

An image forming apparatus 100 is an electrophotographic full-color printer including four image forming portions PY, PM, PC and PK provided corresponding to four colors of yellow, magenta, cyan and black, respectively. In this embodiment, the image forming apparatus 100 is of a tandem type in which the image forming portions PY, PM, PC and PK are disposed along a rotational direction of an intermediary transfer belt 10 described later. The image forming apparatus 100 forms a toner image (image) on a recording material P depending on an image signal from a host device such as an original reader (not shown) communicatably connected with an image forming apparatus main assembly or a personal computer communicatably connected with the image forming apparatus main assembly. As the recording material P, it is possible to cite sheet materials such as a sheet, a plastic film and a cloth.

An outline of such an image forming process will be described. First, in the respective image forming portions PY, PM, PC and PK, toner images of the respective colors are formed on photosensitive drums 1Y, 1M, 1C and 1K, respectively. The thus formed color toner images are transferred onto the intermediary transfer belt 10 and then are transferred from the intermediary transfer belt 10 onto the recording material P. The recording material P on which the toner images are transferred is fed to a fixing device 11, in which the toner images are fixed on the recording material P. This will be described specifically below.

The four image forming portions PY, PM, PC and PK provided in the image forming apparatus 100 have substantially the same except that colors of developers are different from each other. Accordingly, in the following, as a representative, the image forming portion PY will be described, and constituent elements of other image forming portions are represented by replacing a suffix "Y", added to reference numerals or symbols of these in the image forming portion PY, with "M", "C" and "K", respectively, and will be omitted from description.

In the image forming portion PY, as an image bearing member, a cylindrical photosensitive member, i.e., the photosensitive drum 1Y is provided. The photosensitive drum 1Y, for example, 30 mm in diameter, 360 mm in length with respect to a longitudinal direction (rotational axis direction) and 250 mm/sec in process speed (peripheral speed), and is rotationally driven in an arrow direction in FIG. 1. At a periphery of the photosensitive drum 1Y, a charging roller 2Y (charging device), a developing device 4Y, a primary transfer roller 5Y and a cleaning device 6Y are provided. Below the photosensitive drum 1Y in the figure, an exposure device (laser scanner) 3Y is provided.

The charging roller 2Y is, for example, 14 mm in diameter and 320 mm in length with respect to the longitudinal direction and is rotated by the photosensitive drum 1Y during image formation. The charging roller 2Y is urged toward the photosensitive drum 1Y by an urging spring (not shown). Further, to the charging roller 2Y, a charging bias (for example, DC voltage: −900 V, AC peak-to-peak voltage: 1500 V) is applied from a high-voltage source. As a result, the photosensitive drum 1Y is electrically charged substantially uniformly by the charging roller 2Y.

Further, the intermediary transfer belt 10 is disposed opposed to the photosensitive drums 1Y, 1M, 1C and 1K. The intermediary transfer belt 10 is stretched by a plurality of stretching rollers and is circulated and moved in an arrow direction by drive of an inner secondary transfer roller 12 also functioning as a driving roller. At a position opposing the inner secondary transfer roller 12 through the intermediary transfer belt 10, an outer secondary transfer roller 13 as a secondary transfer member is provided, and constitutes a secondary transfer portion T2 where the toner image is transferred from the intermediary transfer belt 10 onto the recording material P. On a side downstream of the secondary transfer portion T2 with respect to a recording material feeding direction, the fixing device 11 is disposed.

A process for forming the image by the image forming apparatus 100 constituted as described above will be described. First, when an image forming operation is started, a surface of the rotating photosensitive drum 1Y is electrically charged uniformly by the charging roller 2. Then, the photosensitive drum 1Y is exposed to laser light emitted from the exposure device 3Y and corresponding to an image signal. As a result, an electrostatic latent image corresponding to the image signal is formed on the photosensitive drum 1Y. The electrostatic latent image on the photosensitive drum 1Y is visualized by the toner accommodated in the developing device 4Y and thus is formed in a visible image (toner image).

The toner image formed on the photosensitive drum 1Y is primary-transferred onto the intermediary transfer belt 10 at a primary transfer portion T1Y constituted between the photosensitive drum 1Y and the intermediary transfer belt 10 sandwiched by the primary transfer roller 5Y and the photosensitive drum 1Y. Toner (transfer residual toner) remaining on the surface of the photosensitive drum 1Y after primary transfer is removed by the cleaning device 6Y.

Such an operation is successively performed also in the respective image forming portions for magenta, cyan and black, so that the resultant four color toner images are superposed on the intermediary transfer belt 10. Thereafter, the recording material P accommodated in a recording material accommodating cassette (not shown) is fed to the secondary transfer portion T2 in synchronism with timing of toner image formation, and the four color toner images are secondary-transferred together from the intermediary transfer belt 10 onto the recording material P. Toner remaining on the intermediary transfer belt 10 which cannot be completely transferred at the secondary transfer portion T2 is removed by an unshown intermediary transfer belt cleaner.

Then, the recording material P is fed to the fixing device 11. The toners (toner images) on the recording material P are melted and mixed under application of heat and pressure, and are fixed as a full-color image on the recording material P. Thereafter, the recording material P is discharged to an outside of the image forming apparatus. As a result, a series of image forming processes is ended. Incidentally, by using only desired image forming portion(s), it is also possible to form an image of a desired signal color or images of desired plurality of colors.

[Developing Device]

Next, the developing device 4Y will be described using FIGS. 2 and 3. Incidentally, also the developing devices 4M, 4C and 4K are similarly constituted. The developing device 4 includes a developing container 41 accommodating a two-component developer containing a non-magnetic toner and a magnetic carrier. The developing container 41 opens at a portion of a developing region opposing the photosensitive drum 1Y, and a developing sleeve 44 as a developer carrying member in which a magnet roller 44*a* is non-rotatably provided is provided so as to be partly exposed at an opening of the developing container 41.

Figure 2:
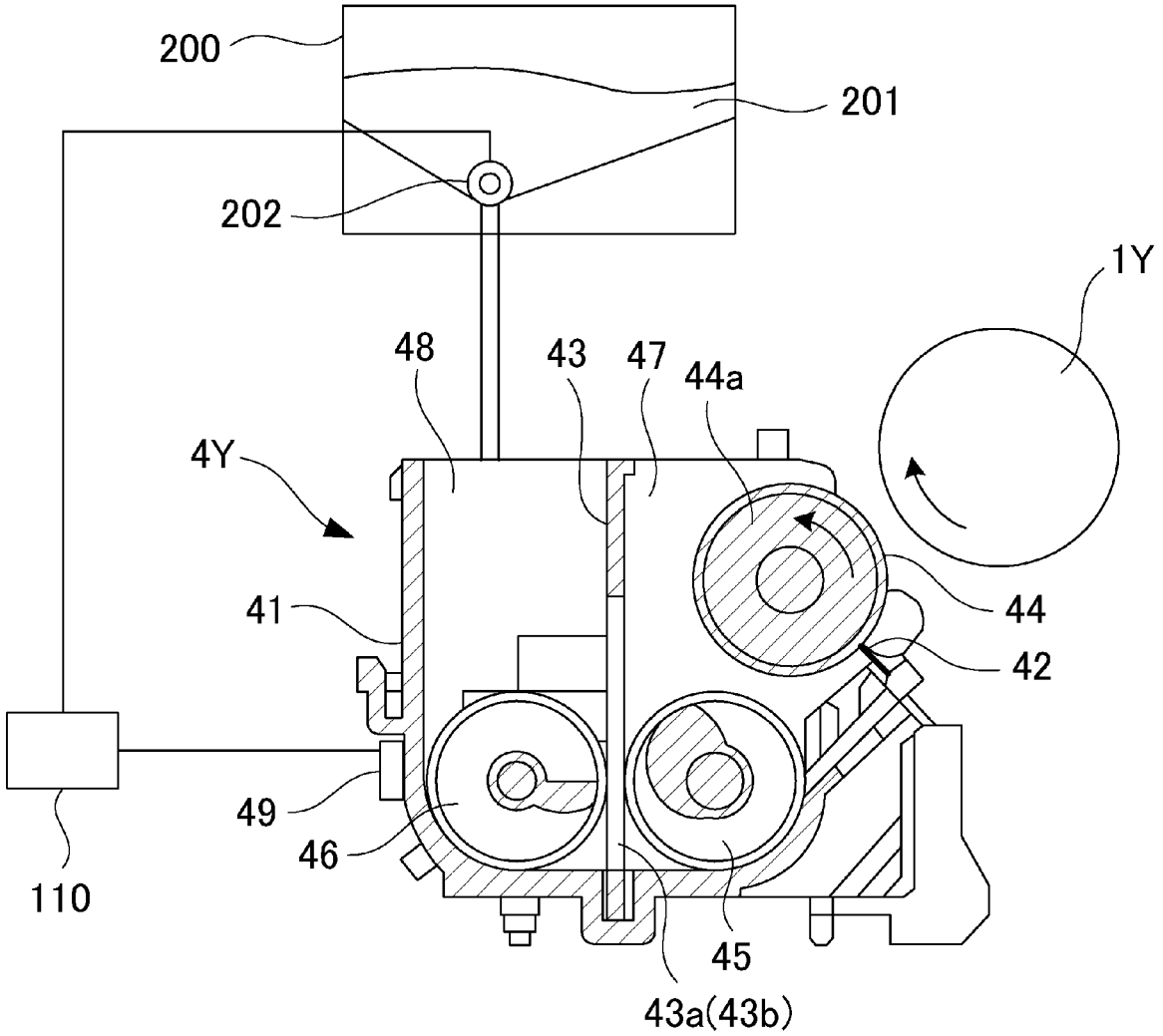
FIG. 2 is a schematic view of a developing device according to the First Embodiment.
Figure 3:
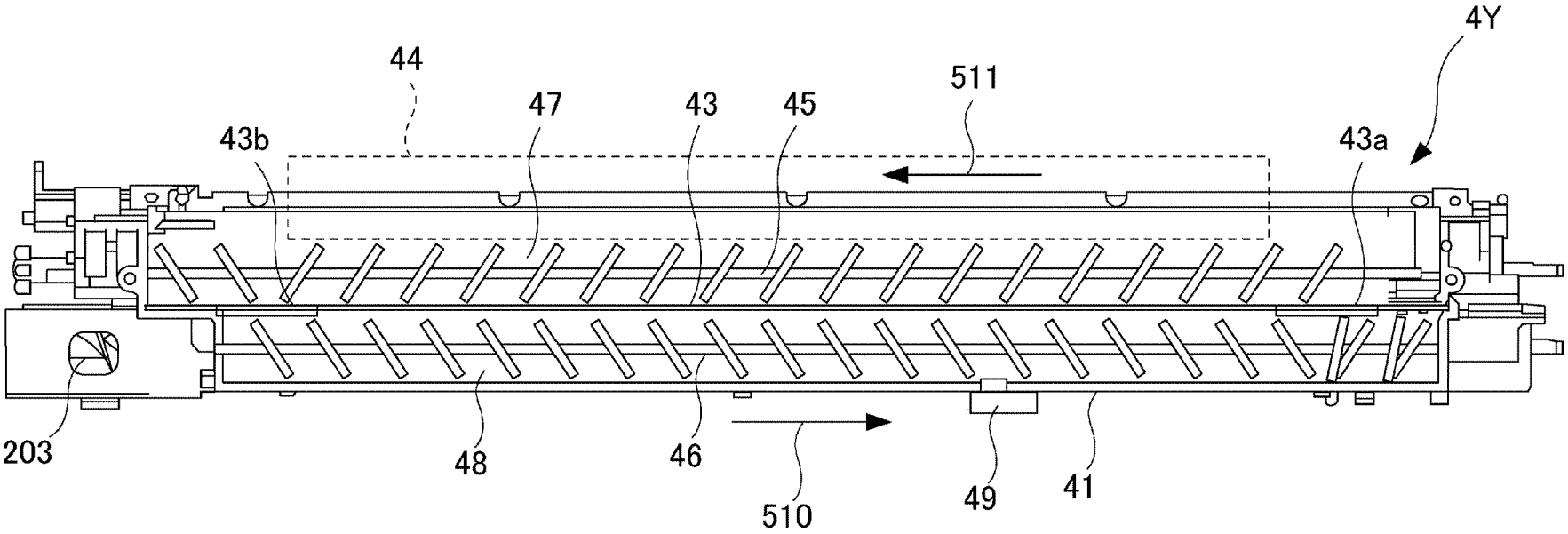
FIG. 3 is a top (plan) view showing the developing device according to the First Embodiment in a partly simplified manner.

In this embodiment, the developing sleeve 44 is constituted by a non-magnetic material, and for example, is 20 mm in diameter and 334 mm in longitudinal length, and is rotated in an arrow direction in FIG. 2 at a process speed (peripheral speed) of 250 mm/sec. The magnet roller 44*a* as a magnetic field generating means includes a plurality of magnetic poles along a circumferential direction, and by a magnetic field generated by the magnetic roller 44*a*, the developer is carried on the surface of the developing sleeve 44.

A layer thickness of the developer carried on the surface of the developing sleeve 44 is regulated by a regulating blade 42, so that a thin layer of the developer is formed on the surface of the developing sleeve 44. The developing sleeve 44 feeds the developer formed in the thin layer to the developing region while carrying the developer. In the developing region, the developer on the developing sleeve 44 is erected and forms a magnetic chain. In this embodiment, the magnetic chain is contacted to the photosensitive drum 1Y, and the toner of the developer is supplied to the photosensitive drum 1Y, so that the electrostatic latent image is developed as the toner image. At this time, in order to improve developing efficiency, i.e., a toner imparting ratio to the latent image, to the developing sleeve 44, a developing bias voltage in the form of a DC voltage biased with an AC voltage is applied from a voltage (power) source. The developer after the latent image is developed with the developer is collected in a developing chamber 47, described later, in the developing container 41 with rotation of the developing sleeve 44.

An inside of the developing container 41 is partitioned into the developing chamber 47 as a first chamber and a stirring chamber 48 as a second chamber by a partition wall 43 extending in a vertical direction. On both end sides of the partition wall 43 with respect to a longitudinal direction (rotational axis direction of the developing sleeve 44), communication ports 43*a* and 43 for establishing communication between the developing chamber 47 and the stirring chamber 48 are formed. As a result, a developer circulating path is formed by the developing chamber 47 and the stirring chamber 48.

Further, in the developing container 41, a first screw 45 as a first feeding member for feeding the developer while stirring the developer and a second screw 46 as a second feeding member for feeding the developer while stirring the developer are provided. The first screw 45 is disposed in the developing chamber 47 and feeds the developer accommodated in the developing chamber 47 in an arrow 511 direction in FIG. 3 while stirring the developer, and supplies the developer to the developing sleeve 44. The second screw 46 is disposed in the stirring chamber 48 and feeds the developer accommodated in the stirring chamber 48 in an arrow 510 direction in FIG. 3 while stirring the developer.

Above the developing device 4Y, a hopper 200 as a developer supplying device accommodating a supply developer 201 consisting only of the toner or consisting of the toner and the magnetic carrier is provided as shown in FIG. 2. In the hopper 200, a supplying screw 202 is provided and is capable of supplying the toner, in an amount corresponding to an amount of the toner used for image formation, from the hopper 200 to the inside of the developing container 41 through a supply opening 203 (FIG. 3). A supply amount of the developer is adjusted by a number of rotations of the supplying screw 202 by a controller 110 as a control means.

The controller 110 carries out not only control of the supplying screw 202 but also control of an entirety of the image forming apparatus 100. Such a controller 110 includes a CPU (central processing unit), a ROM (read only memory) and a RAM (random access memory). The CPU carries out control of respective portions while reading a program corresponding to a control procedure stored in the ROM. Further, in the RAM, operation data and input data are stored, and the CPU carries out control by making reference to the data stored in the RAM, on the basis of the above-described program or the like.

The developing device 4Y includes a toner content sensor 49 as a density detecting means capable of detecting a toner content (proportion of a weight of toner particles to a total weight of carrier particles and the toner particles, T/D ratio) in the developing container 41. The toner content sensor 49 is provided to the stirring chamber 48 and detects the toner content in the stirring chamber 48. In this embodiment, as the toner content sensor 49, an inductance sensor is used, and a sensor surface (detecting surface) of the inductance sensor is exposed to the inside of the stirring chamber 48. The inductance sensor detects permeability in a predetermined detection range through the sensor surface. When the toner content of the developer changes, also the permeability due to a mixing ratio between the magnetic carrier and the non-magnetic toner changes, and therefore, the change in permeability is detected by the inductance sensor, so that the toner content can be detected.

The controller 110 determines a supply amount of the developer from the hopper 200 on the basis of a result of detection of the toner content in the developing container 41 by the toner content sensor 49. Incidentally, a toner image (patch image) for control is formed on the photosensitive drum 1Y or the intermediary transfer belt 10, and a density (content) of the patch image is detected by an unshown sensor, and then a detection result thereof is reflected in the above-described supply amount in some cases. This sensor includes, for example, a light-emitting portion and a light-receiving portion, and detects the density of the patch image by receiving, at the light-receiving portion, reflected light of light emitted from the light-emitting portion toward the patch image. Further, also in some cases, the controller 110 reflects a video count value in the above-described supply amount. The video count value is a value obtained by integrating a level (for example, 0-255 levels) per (one) pixel of an inputted image data in an amount corresponding to one image screen.

[Circulation of Developer]

Next, circulation of the developer in the developing container 41 will be described. The first screw 45 and the second screw 46 are disposed substantially in parallel to each other along the rotational axis direction of the developing sleeve 44. The first screw 45 and the second screw 46 feed the developer in opposite directions along the rotational axis direction of the developing sleeve 44. Thus, the developer is circulated in the developing container 41 through the communication points 43*a* and 43*b* by the first screw 45 and the second screw 46.

That is, by a feeding force of the first screw 45 and the second screw 46, the developer, on the developing sleeve 44, in which the toner is consumed in a developing step and the toner content lowers is collected in the developing chamber 47 and is fed to the stirring chamber 48 through the communication port 43*b*, and then moves in the stirring chamber 48. Further, also the developer, in the developing chamber 47, which is not coated on the developing sleeve 44 moves in the developing chamber 47 and then moves into the stirring chamber 48 through the communication port 43*b*.

Here, on a side upstream of the communication port 43*b* of the stirring chamber 48 with respect to the developer feeding direction of the second screw 46, the supply opening 203 through which the developer is supplied from the hopper 200. For this reason, in the stirring chamber 48, the developer fed from the developing chamber 47 through the communication port 43*b* and the supply developer 201 supplied from the hopper 200 through the supply opening 203 are fed by the second screw 46 while being stirred by the second screw 46. Then, the developer fed by the second screw 46 is moved to the developing chamber 47 through the first communication port 43*a*.

[Developer]

Here, the two-component developer used in this embodiment will be described. As the developer, the developer obtained by mixing a negatively chargeable non-magnetic toner and a positively chargeable magnetic carrier is used. The non-magnetic toner is obtained by adding from powder of titanium oxide, silica or the like to a surface of powder prepared by incorporating a colorant, a wax component and the like into a resin material such as polyester or styrene-acrylic resin and then by subjecting a resultant mixture to pulverization or polymerization. The magnetic carrier is obtained by subjected, to resin coating, a surface layer of a core formed with ferrite particles or resin particles kneaded with magnetic powder. The content of the toner in the developer in an initial state is 8%-10%, for example.

[Stirring Property and Feeding Property of Developer]

Next, a stirring property and a feeding property of the developer by the second screw for feeding the developer in the stirring chamber will be described. To the stirring chamber, the supply developer is supplied as described above, and therefore, the second screw is required to compatibly realize the stirring property and the feeding property of the developer. First, the stirring property will be described.

Figure 4:
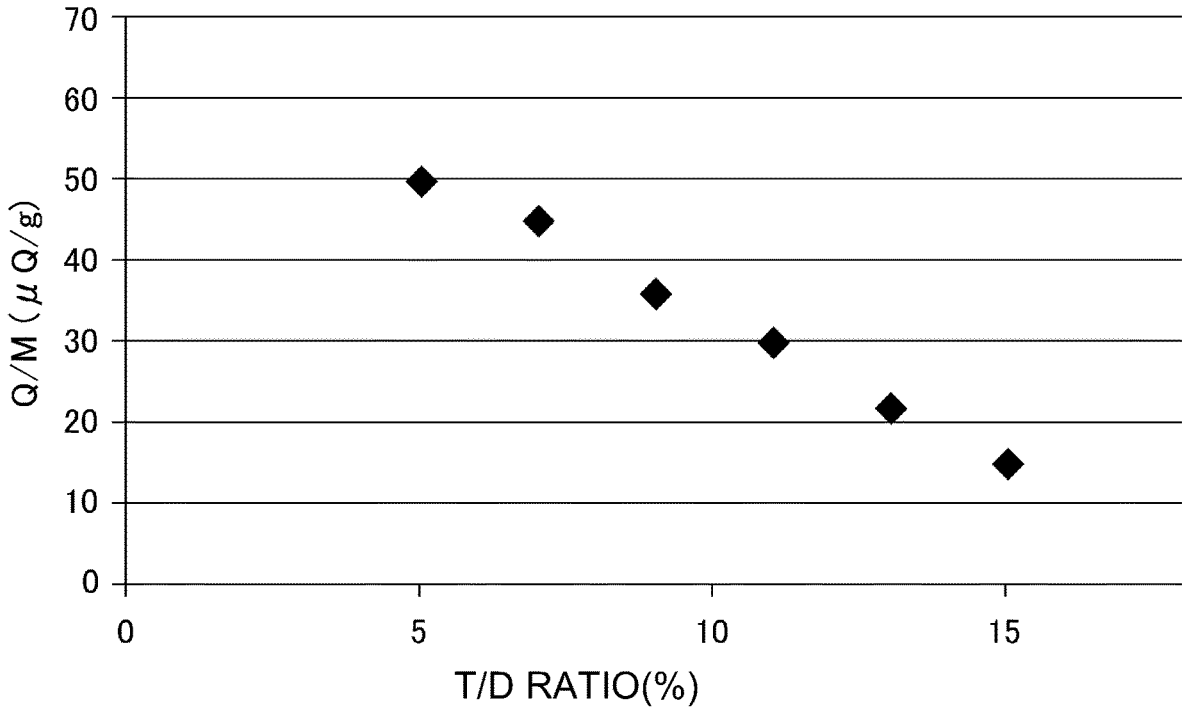
FIG. 4 is a graph showing a relationship between a toner content (T/D ratio) and a toner charge amount (Q/M).

In order to faithfully develop, with the toner, the electrostatic latent image formed on the photosensitive drum, it is desired that a charge amount (Q/M) of the toner in the developing container is stabilized. The charged amount (Q/M) of the toner has, as shown in FIG. 4, a tendency that the charge amount of the toner depends on the toner content (T/D ratio) of the developer. That is, when the toner content of the developer is excessively high, the toner charge amount becomes low, and when the toner content of the developer is excessively low, the toner is excessively charged electrically. With an increasing toner charge amount, an amount of the toner used for developing the latent image on the photosensitive drum becomes small, and therefore, when the toner charge amount causes non-uniformity, density non-uniformity generates on the toner image on the photosensitive drum.

Further, the toner is charged by friction with the carrier, and therefore, when the toner content of the developer is locally high in the developing container, a coating ratio of the toner to the carrier becomes excessively high, so that the toner charge amount is insufficient. As a result, toner flying (fog) to a non-image portion on the photosensitive drum, toner scattering to an outside of the developing container and the like can occur.

Further, due to an increase in toner charge amount or the like, when a bulk of the developer becomes high, the supply developer is not readily taken within a rotation radius region of the screw. For this reason, the supply developer is fed while sliding on the developer which has already existed in the developing container, so that the supply developer reaches the developing chamber while being satisfactorily stirred and thus can be scooped by the developing sleeve in some cases.

The toner content of the developer immediately after the supply developer is supplied is high, but on the other hand, the toner is consumed by the developing sleeve and thus the toner content of the developer collected in the developing container is low. Accordingly, it is desired that the above-described developers different in toner content are quickly stirred and mixed and thus the toner content of the developer in the developing container is stabilized.

Next, the feeding property of the developer will be described. In order to supply, to the developing sleeve, the toner in the same amount as a toner consumption amount proportional to an output image density, it is desired that a feeding speed of the developer is maintained by the screw at a level not less than a predetermined speed. When the developer feeding speed is slow, in the case where images with a high image density are continuously formed, a time until the supplied developer reaches the developing sleeve becomes large (slow). Then, the toner content of the developer scooped by the developing sleeve lowers, so that the image density gradually becomes thick. For this reason, it is desired that the supplied developer is caused to quickly reach the developing sleeve by ensuring the developer feeding speed at a level not less than a predetermined speed. Thus, the second screw for feeding the developer immediately after being supplied is desired to compatibly realize ensuring of the developer stirring property and ensuring of the developer feeding property.

[Single Thread Screw]

Figure 5:
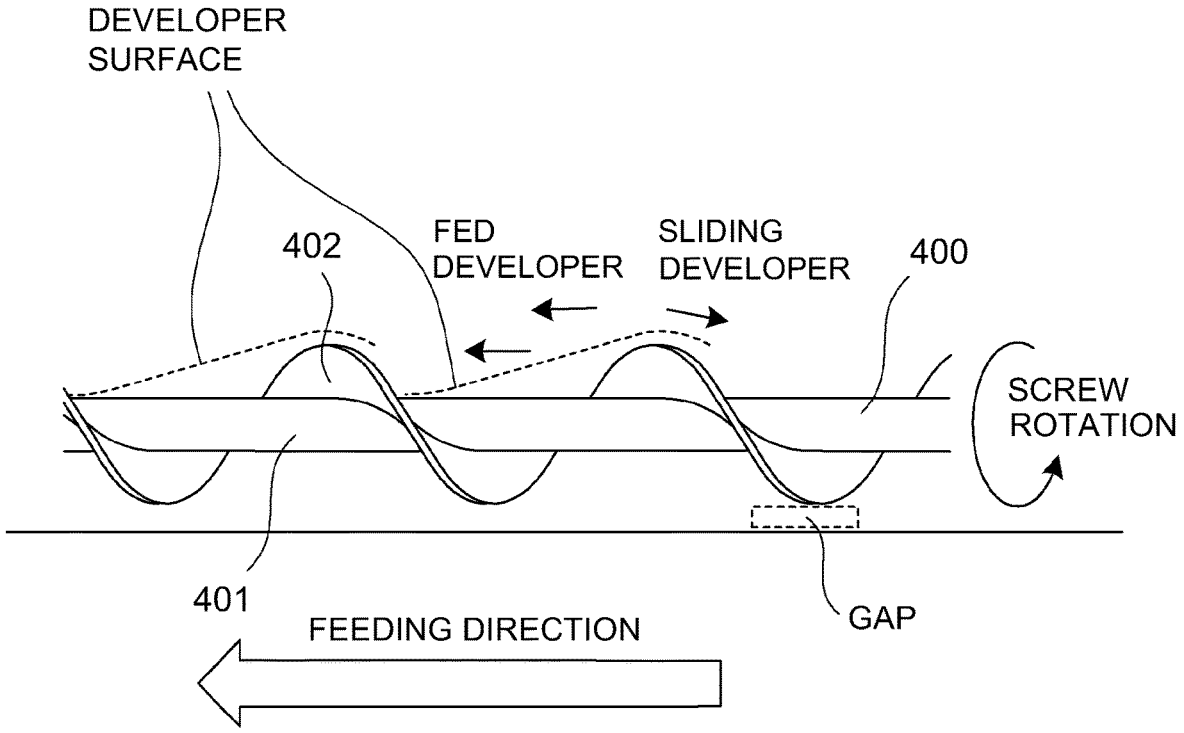
FIG. 5 is a schematic view for illustrating a developer feeding property of a single thread screw.

Next, the developer feeding property in the case where a single thread feeding screw 400 shown in FIG. 5 is used as the screw for feeding the developer in the developing container will be described. The feeding screw 400 includes a single thread blade 402 helically formed around a rotation shaft 401. The developer is fed with rotation of the feeding screw 400 about the rotation shaft 401. In FIG. 5, a broken line on the feeding screw 400 represents a surface of the developer.

The developer between adjacent portions of the blade 402 of the feeding screw 400 is fed so as to be pushed out by rotation of the blade 402. The developer fed by being pushed out is fed in a distance equal to a screw pitch, per (one) rotation of the feeding screw 400. On the other hand, a part of the developer slides on the blade 402 on an upstream side of the feeding direction or stagnates in a gap between the blade 402 and an inner wall of the developing container, so that the developer feeding speed becomes slow.

In order to increase the developer feeding speed of the feeding screw 400, it is required that developer feeding efficiency of the feeding screw 400 is enhanced. That is, it is desired that an amount of the developer which slides on the blade 402 or which stagnates in the gap is decreased as small as possible, and thus an amount of the developer moved in the distance equal to the screw pitch by the rotation of the feeding screw 400.

Figure 6:
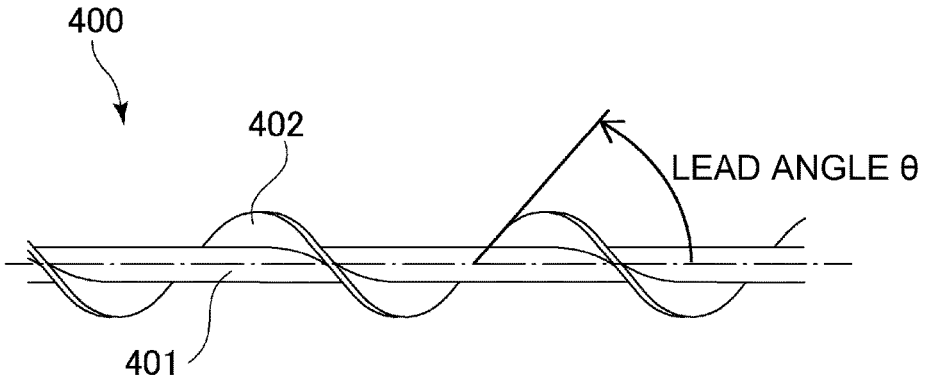
FIG. 6 is a schematic view for illustrating a lead angle of a blade.
Figure 7:
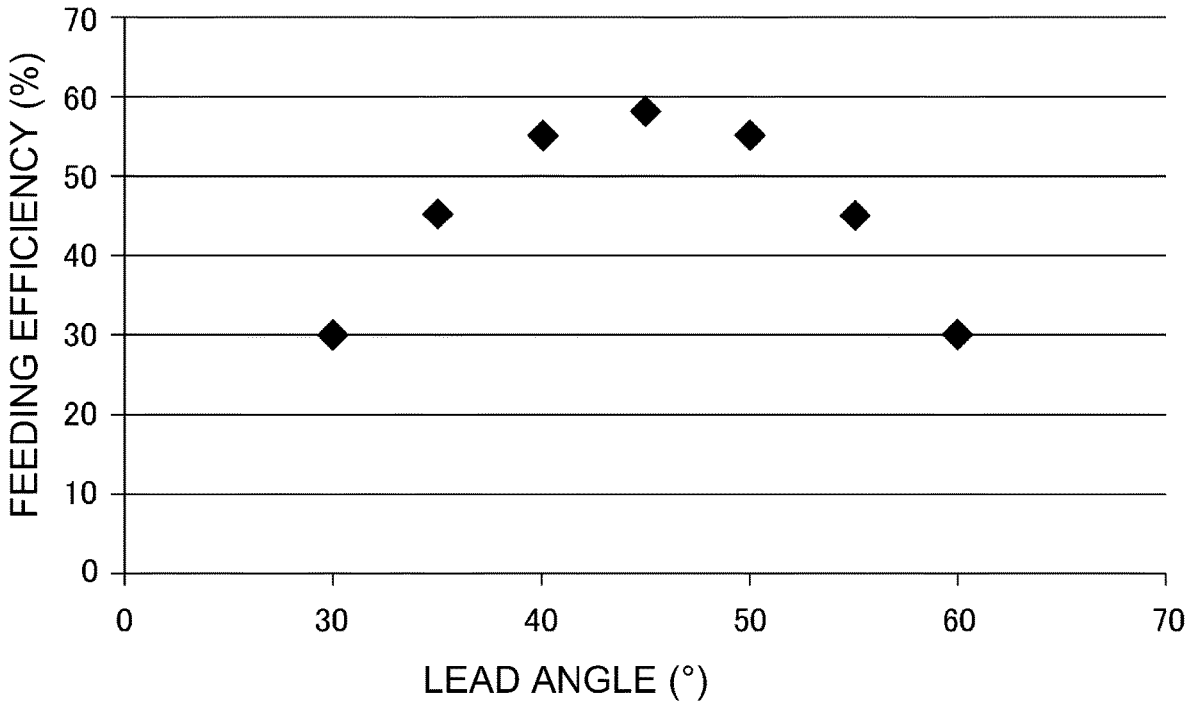
FIG. 7 is a graph showing a relationship between the lead angle and a feeding efficiency.

As shown in FIG. 6, when a lead angle of the helical blade 402 is an angle formed between the rotation shaft 401 and the blade 402 of the feeding screw 400, the developer feeding efficiency of the feeding screw 400 depends on the lead angle, and a tendency thereof is, for example, as shown in FIG. 7. However, this tendency varies depending on a shaft diameter of the feeding screw, a cross-sectional area of the inner wall of the developing container, and the like.

However, the developer feeding efficiency of the feeding screw 400 is enhanced, most of the developer between the adjacent portions of the blade 402 is fed without being satisfactorily stirred. Here, the case where the supplied toner exists in a large amount in the developer between the adjacent portions of the blade 402 and is not completely mixed satisfactorily will be considered. In the case where the lead angle is large and the feeding efficiency is low, the developer sliding on the blade 402 extends in the longitudinal direction, and therefore, the supply toner is satisfactorily dispersed. On the other hand, in the case of the lead angle such that the feeding efficiency is high, the amount of the developer sliding on the blade 402 is small, and therefore, the toner between the adjacent portions of the blade 402 is not readily dispersed in the longitudinal direction.

Further, for example, in the case where the feeding screw is prepared as a multi-thread screw including a plurality of blades provided with threads, the developer feeding property is easily ensured, but the developer stirring property lowers, so that as described above, the toner charge amount causes non-uniformity in the developing container.

Particularly, in the case where the amount of the developer accommodated in the developing container is decreased by downsizing the developing device, it is difficult to compatibly realize ensuring of the developer feeding property and ensuring of the developer stirring property. For example, in the case where the developing device is downsized, it would be considered that the diameter of the feeding screw is decreased, but in the case, an area in which the developer is pushed by the blade is decreased, and therefore, the developer feeding property of the feeding screw is liable to lower. For this reason, it would be considered that the developer feeding property is enhanced by forming the feeding screw in the multi-thread screw, but in this case, the developer stirring property lowers.

[Second Screw of this Embodiment]

Therefore, in this embodiment, each of the first screw 45 and the second screw 46 is prepared in the form of the multi-thread screw including the plurality of blades provided with threads. Further, as regards the second screw 46 for feeding the developer in the stirring chamber 48, of the plurality of blades (threads), at least one blade (thread) is provided with a gap portion where the blade (thread) is discontinuous. In the following, the second screw 46 will be specifically described with reference to FIGS. 8 to 10.

Figure 8:
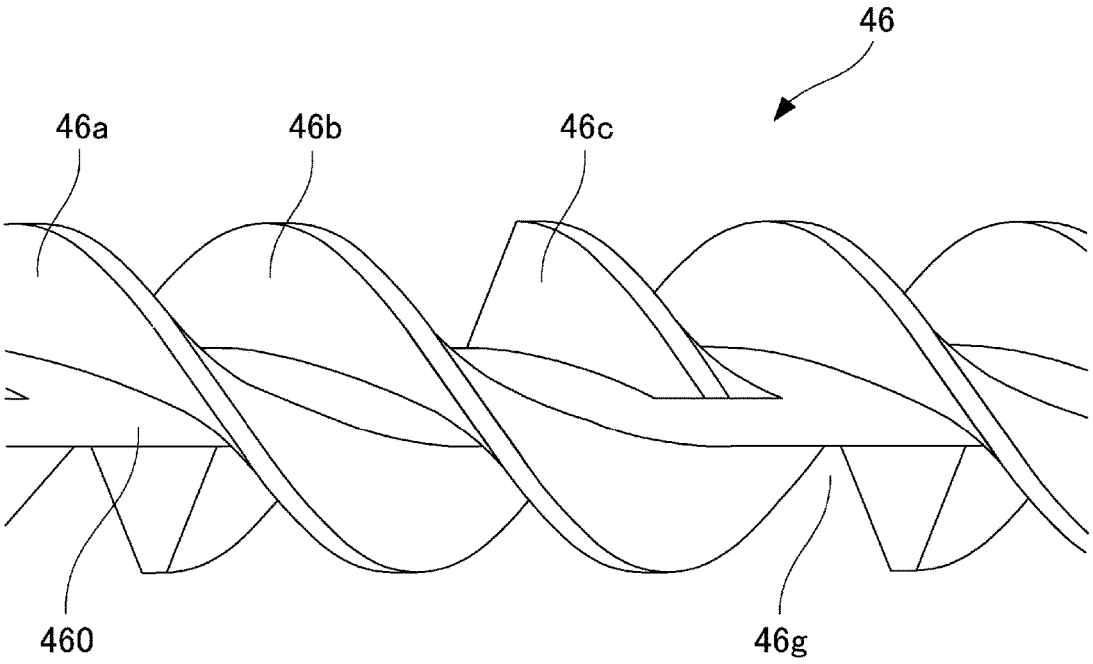
FIG. 8 is a schematic view showing a part of a second screw according to the First Embodiment.

As shown in FIG. 8, the second screw 46 includes a rotation shaft 460 and includes, at a periphery of the rotation shaft 460, a plurality of blades 46*a* (first blade), 46*b* (fourth blade) and 46*c* (second blade, third blade) provided with threads. In this embodiment, the second screw 46 is a three-thread screw including three blades 46*a*, 46*b* and 46*c* provided with threads. Further, of the plurality of blades 46*a*, 46*b* and 46*c*, the blades 46*a* and 46*b* as the first blade provided with at least one thread (two threads in this embodiment) have a continuous shape over an axial direction of the rotation shaft 460.

On the other hand, the blade 46*c* as the second blade (third blade) which is different from the first blade and which is provided with at least one thread (single thread in this embodiment) is formed so that at least one region including a plurality of gap portions 46*g* each in which the blade 46*c* is discontinuous in one pitch thereof exists in an entire area of the blade 46 with respect to the axial direction. That is, a part of the blade 46*c* is removed, and this part constitutes the gap portion 46*g*. The three blades 46*a*, 46*b* and 46*c* providing the three threads are formed in the named order with respect to the developer feeding direction with the same outer diameter and the same pitch.

Incidentally, the first screw 45 is a three-thread screw similarly as the second screw 46, but any of the blades is not provided with the gap portion. However, also the first screw 45 may be formed in a shape such that at least one of the blades (threads) is provided with the gap portion similarly as in the case of the second screw 46. Further, the first screw 45 may preferably be the screw including the three blades 46*a*, 46*b* and 46*c* (i.e., including the three threads) similarly as the second screw 46. That is, the first screw 45 may preferably be the screw which has the outer diameter, the pitch and the number of threads which are the same as those of the second screw 46, and in this case, the gap portion may be provided similarly as in the case of the second screw 46 and may also be not provided.

The blade 46*c* of the second screw 46 includes the gap portions 46*g* formed periodically over an entire area of the blade 46*c* with respect to the axial direction. That is, the region including the plurality of gap portions 46*g* in one pitch exists over an entire area of the second screw 46 with respect to the axial direction. In this embodiment, the blade 46*c* and the gap portion 46*g* are disposed so as to alternately exist every 90° with respect to a phase of the second screw 46 along a rotational direction of the second screw 46.

Figure 9:
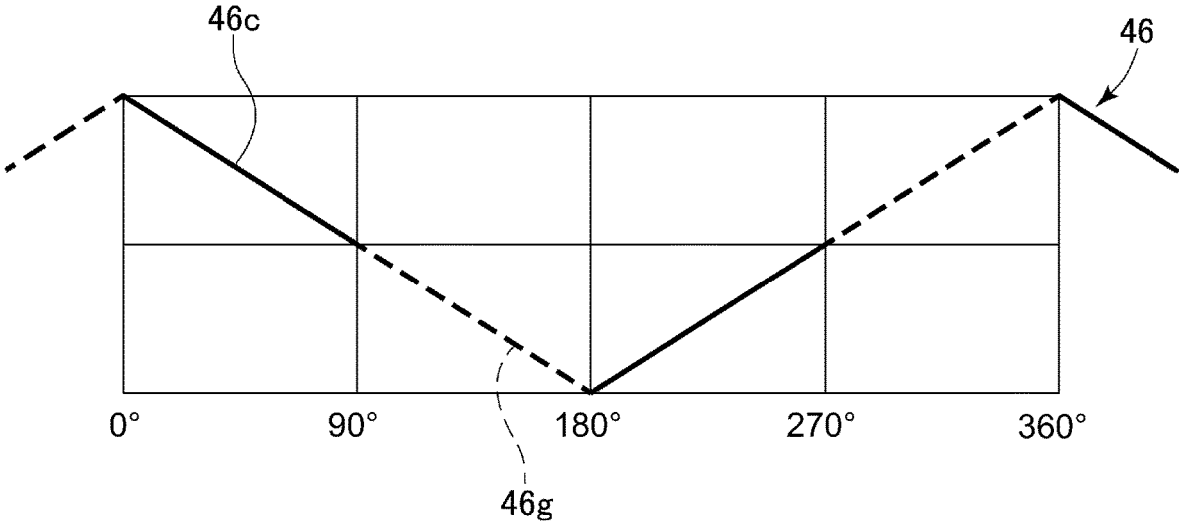
FIG. 9 is a schematic view showing a phase of a second blade of the second screw according to the First Embodiment.

FIG. 9 schematically illustrates the pitch of the second screw 46 by paying attention only to the blade 46*c*. In FIG. 9, an outer rectangular frame represents the pitch. A thick solid line represents a portion of the blade 46*c*, and a thick broken line represents the gap portion 46*g*. As shown in FIG. 9, the blade 46 is formed so that a portion where the blade 46*c* exists and the gap portion 46*g* alternately appear every 90°. Accordingly, in this embodiment, two gap portions 46*g* exist in one pitch. Further, in the case where the portions of the blade 46*c* are viewed from the axial direction in one-full circumference, the blade 46*c* and the gap portion 46*g* alternately exist in the number corresponding to the same phase. Further, an areal ratio between the blade 46*c* and the gap portion 46*g* when the portions of the blade 46*c* are projected in the axial direction through one-full circumference is 1:1. Incidentally, in this embodiment, the angle of the gap portion was 90°, but the present invention is not limited thereto. A similar effect can be obtained when the angle of the gap portion is in a range of 45° or more and 135° or less.

Figure 10:
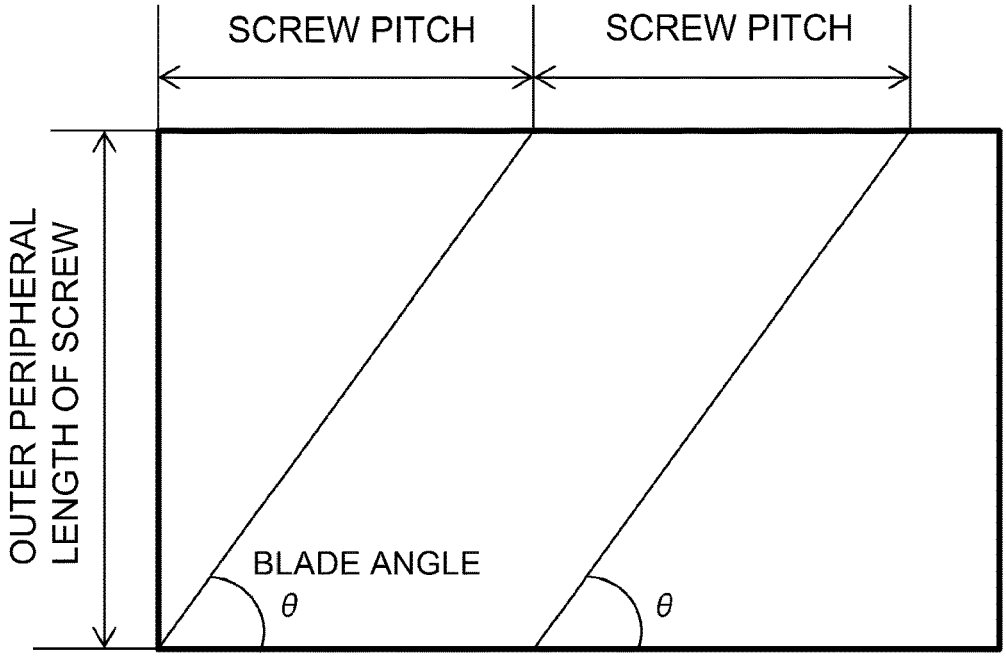
FIG. 10 is a schematic view for illustrating a helix angle of the blade.

Here, FIG. 10 is a schematic view for illustrating an angle of the helical blade, wherein a length of an outer periphery of a circle with a diameter equal to an outer diameter of the blade 46*c* (i.e., a screw outer peripheral length) is the ordinate and a length of the blade 46*c* with respect to an axial direction is the abscissa. An angle formed between a crest of the helical blade and the abscissa is a blade angle θ (helix angle) of the blade 46*c*. In this case, the angle θ of the blade 46*c* is 80° or less. Particularly, the angle θ of the blade 46*c* may preferably be 39° or more and 80° or less, more preferably be 50° or more and 60° or less. Incidentally, also angles θ of the blades 46*a* and 46*b* may preferably be the same as the angle θ of the blade 46*c*.

Further, the outer diameter of the second screw 46 may preferably be 12 mm or more and 20 mm or less, more preferably be 14 mm or more and 17 mm or less. Incidentally, all the blades 46*a*, 46*c* and 46*c* have the same outer diameter, and therefore, the outer diameter of the second screw 46 equals to the outer diameter of the blade 46*c*, for example. The pitches of the blades 46*a*, 46*b* and 46*c* of the second blade 46 are, for example, 30 mm so that the lead angle is 45° in view of a tendency of FIG. 7.

Thus, in the case of this embodiment, the second screw 46 is formed not only as the three-thread screw but also in a shape such that of the three blades (threads), the two blades (threads) 46*a* and 46*b* have a continuous shape over the axial direction thereof. Further, the single thread blade 46*c* is formed so that the region including a plurality of gap portions 46*g* in one pitch exists in at least one position of an entire area of the blade 46*c* with respect to the axial direction, and in this embodiment, is formed so that the region exists over the entire area.

For this reason, the developer feeding property can be ensured by the two blades (threads) 46*a* and 46*b*, and the developer stirring property can be ensured by the remaining single blade (thread) 46*c*. That is, of the three blades (threads) 46*a*, 46*b* and 46*c*, the two blades 46*a* and 46*b* are higher in developer feeding force than the blade 46*c*, and the blade 46*c* is higher in developer stirring force than the blades 46*a* and 46*b*.

Figure 11:
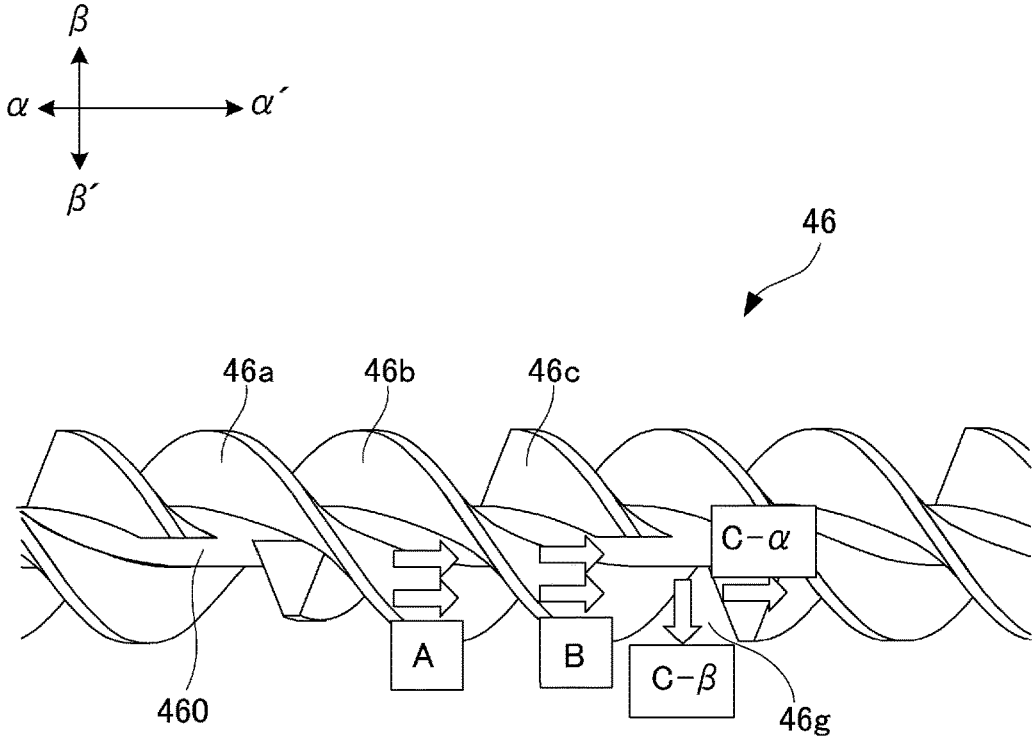
FIG. 11 is a schematic view for illustrating motion of a developer by the second screw according to the First Embodiment.

This will be described using FIG. 11. An a-a' direction shown in FIG. 11 shows a developer feeding direction (arrow 510 direction of FIG. 3) by the second screw 46. On the other hand, β-β' direction (or β-β' direction) shows a direction in which the developer is stirred by the second screw 46. In an example shown in FIG. 11, the β-β' direction (or β'-β direction) is a direction perpendicular to the α-α' direction.

First, by the continuously and helically formed blades 46*a* and 46*b*, the developer is successively fed in the α-α' direction as indicated by arrows A and then by arrows B. When the developer reaches the helical blade 46*c* including the gap portion 46*g*, the direction of a flow of the developer is divided into an arrow C-α direction (feeding direction) and an arrow C-β direction (stirring direction) by existence of the gap portion 46*g*. Here, in FIG. 11, two arrows A and two arrows B are indicated and on the other hand, a single arrow C-α and a single arrow C-β are indicated. This is because the division of the flow of the developer is schematically illustrated. Accordingly, the number of these arrows is not intended to mean that the flow of the developer is not necessarily divided with a ratio of 1:1.

On the other hand, in the case where as the second screw, the three-thread screw including the three blades (threads) each provided with no gap portion, at all of the blades (threads), the developer flows as indicated by the arrows A and B, so that the flow of the developer as indicated by the arrow C-β, i.e., the flow of the developer in the stirring direction, does not readily generate.

Accordingly, as in this embodiment, as the second screw 46, by using the screw including at least the single thread blade provided with the gap portion 46*g*, components of the flow of the developer in the feeding direction and the stirring direction as shown in FIG. 11 can be easily generated at the gap portion 46*g*. As a result, the developer inside the rotation radius region of the blade 46*c* can be satisfactorily stirred with the developer outside the rotation radius region of the blade 46*c*, so that the stirring property of the supply developer can be improved.

Further, of the three blades (threads) 46*a*, 46*b* and 46*c*, by the blade (thread) 46*c*, the flow of the developer is divided, and therefore, the developer feeding speed locally lowers. However, the developer feeding performance can be ensured by the remaining two blades (threads) 46*a* and 46*b*. For this reason, the developer feeding speed as the entire screw hardly lowers compared with the screw provided with no gap portion and with the same number of threads.

Thus, the second screw 46 in this embodiment is capable of ensuring the feeding performance in the stirring chamber 48 by forming the blades 46*a* and 46*b* in a continuous shape and is capable of improving the stirring performance while assisting the feeding performance, by providing the blade 46*c* with the gap portion 46*g*. Accordingly, speed-up of the image forming apparatus can be met and the developer in a small amount can be quickly stirred with the supply developer.

In the above-described explanation, the blade 46*c* was formed with the pitch of 30 mm equal to those of other blades 46*a* and 46*b*, but the blade 46*c* may also be formed with a pitch different from those of the blades 46*a* and 46*b* when the blade 46*c* is disposed corresponding to a region sandwiched between the blade 46*b* and the blade 46*a*.

Further, the screw having a constitution including the blades 46*a*, 46*b* and 46*c* as described above may also be applied to the first screw 45 disposed in the developing chamber 47, in addition to the second screw 46 disposed in the stirring chamber 48. Further, such a screw can also be applied to a screw for feeding the developer at another portion while stirring the developer.

[Experiment]

An experiment for confirming an effect of the above-described embodiment will be described. The experiment in which the above-described developing device 4Y was provided in an apparatus capable of being driven alone and a stirring state of the developer was observed through a high-speed camera ("Phantom v10", manufactured by Vision Research Inc.) was conducted. In this experiment, developers (yellow developer and cyan developer) of two kinds different in color were used. Each of the developer developers was prepared so as to have a T/D ratio of 8%. First, 100 g of the yellow developer is placed in the developing container 41, and the first screw 45, the second screw 46 and the developing sleeve 44 are driven for 2 minutes. Thus, the yellow developer is in a state in which the surface thereof is uniformly leveled off in the developing chamber 41.

Then, 100 g of the cyan developer is uniformly placed on the yellow developer. In this state, when the drive is started again, a state in which the yellow and cyan (two color) developers are gradually mixed with each other and are prepared in a uniform green developer sooner or later is observed. This change in color was observed from above through the high-speed camera, and a change in luminance value was converted into the form of numbers (numeric values) as an index of the stirring state. When an initial luminance (brightness) is L1 and luminance (brightness) during an end of stirring (in a steady state) was L2, conversion of the change in luminance value into the form of numbers was carried out using the following equation:

$$\text{Stirring state } (\%) = (L-L1)/(L2-L1).$$

Figure 12:
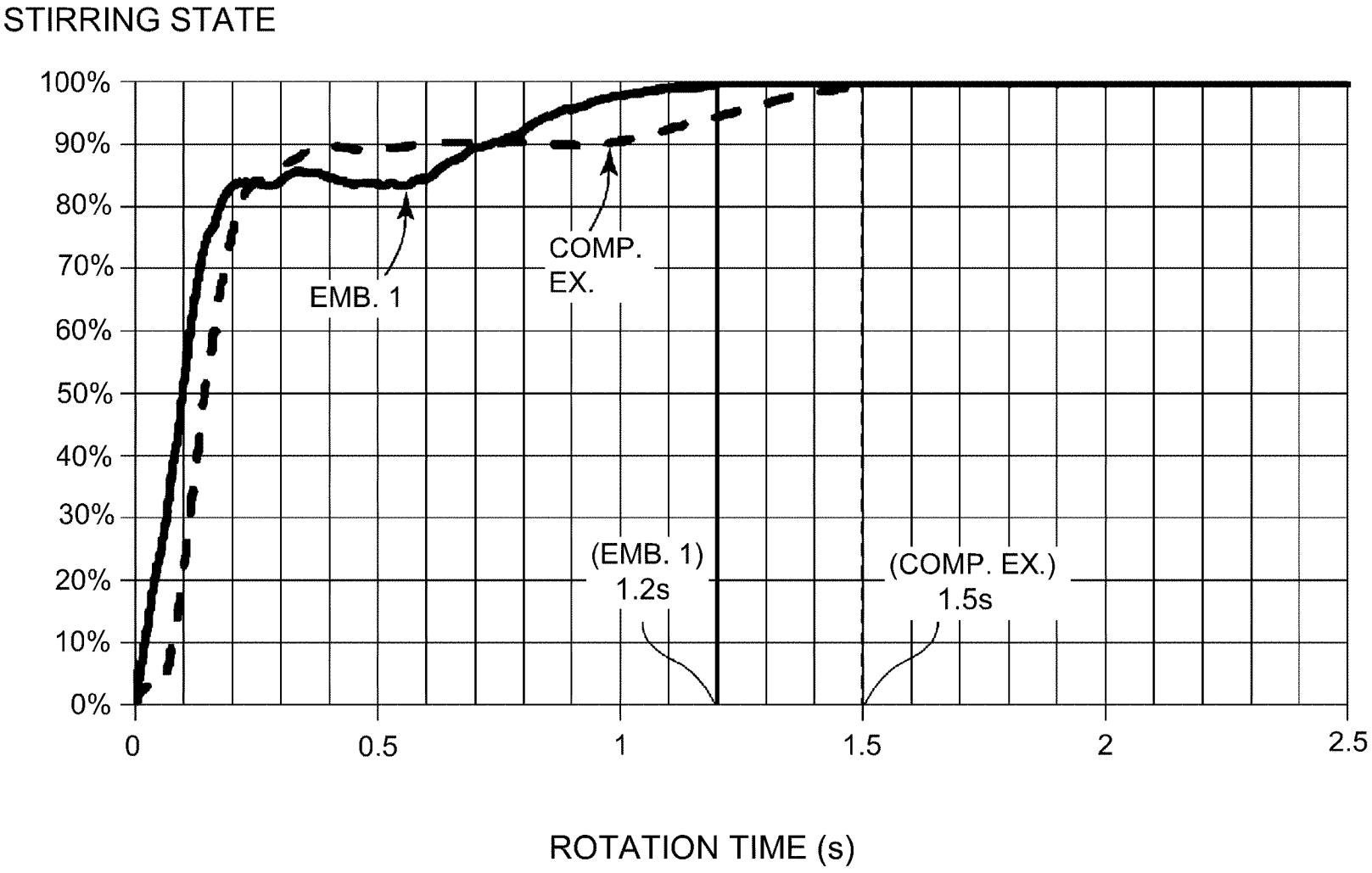
FIG. 12 is a graph showing a relationship between a screw rotation time and a screw stirring state in the First Embodiment and a comparison example.

FIG. 12 shows a result of the experiment. In FIG. 12, "EMB. 1" shows the result of use of the constitution of the above-described embodiment, and "COMP. EX." shows the result of use of a constitution in which different from this embodiment, the screw is not provided with the gap portion. The same condition was used between Embodiment 1 (this embodiment) and the comparison example except that the gap portion was provided or was not provided. In the case of the comparison example, 1.5 seconds was required until the end of the stirring (stirring state: 100%). On the other hand, in the case of this embodiment, the stirring was ended in 1.2 seconds. As described above, it turned out that as in this embodiment, by periodically providing at least one thread of the threads of the multi-thread screw with the gap portions, the developer stirring performance was improved.

Second Embodiment

Figure 13:
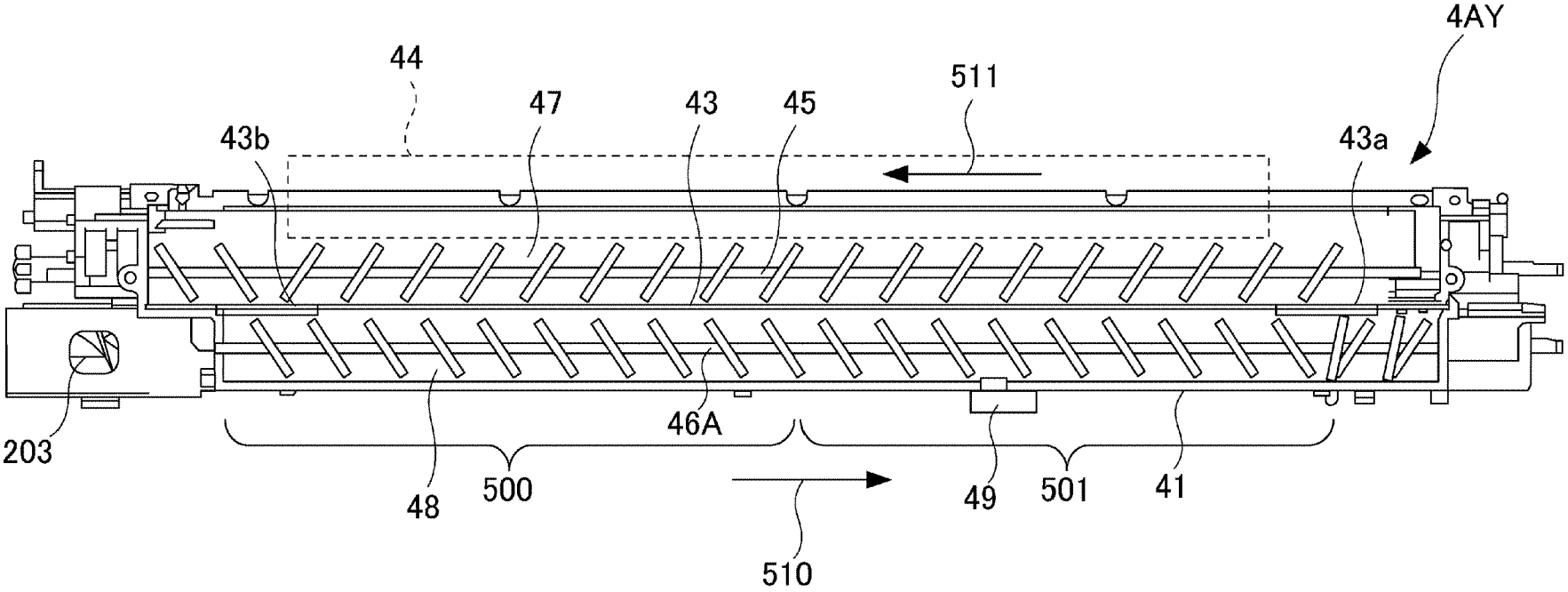
FIG. 13 is a top (plan) view showing a developing device according to a Second Embodiment in a partly simplified manner.

Second Embodiment will be described using FIG. 13. A second screw 46A in this embodiment is, similarly as in First Embodiment, a screw for feeding the developer in a stirring chamber 48 while stirring the developer and including a three-thread blade including three blades (threads) helically formed around a rotation shaft 460. However, in the case of this embodiment, different from the First Embodiment, one blade (thread) is provided with the gap portions in a part of a region of the second screw 46A. Other two blades (threads) are formed in the continuous shape over the entire area of the second screw 46A with respect to the axial direction similarly as in the case of the blades (threads) 46*a* and 46*b* of the First Embodiment. Other constitutions and actions are similar to those of the First Embodiment described above. In the following, constituent elements similar to those of the First Embodiment will be omitted from description and illustration or will be briefly described or illustrated, and a portion different from the First Embodiment will be principally described.

The one (single) blade (second blade) includes a first region 500 where a plurality of gap portions are formed over the axial direction and includes a second region 501 where the blade is continuously formed over the axial direction. In this embodiment, an upstream half of an entire region of the single blade with respect to the feeding direction (arrow 510 direction) in the stirring chamber 48 is the first region 500 where the periodical gap portions similar to those of the blade 46*c* in the First Embodiment are disposed. On the other hand, a downstream half of the entire region of the single blade is the second region 501 where the blade is continuous over the axial direction, i.e., the gap portions do not exist.

Further, the first region 500 exists on a side upstream of a toner content sensor 49 and downstream of the supply opening 203, through which the developer is supplied from the developer accommodating container, with respect to the developer feeding direction (arrow 510 direction) of the second screw 46A. This is because the developer is sufficiently stirred before the developer reaches the toner content sensor 49. That is, in the case where the toner content of the developer which is not sufficiently stirred is detected by the toner content sensor 49, detection accuracy of the toner content in the developing container lowers, so that control of developer supply or the like on the basis of a detection result of the toner content sensor 49 is not readily carried out appropriately. Accordingly, the gap portions may preferably be caused to exist on the side upstream of the toner content sensor 49 so that the developer can be stirred sufficiently before the developer reaches the toner content sensor 49.

In the case of this embodiment described above, the region (first region 500) where the blade is provided with the gap portions is limited to a part of the entire region of the screw with respect to the longitudinal direction, so that an area of the blade in an entirety of the second screw 46A can be made larger than that in the First Embodiment. As a result, the developer feeding speed can be maintained at a high level.

Incidentally, in this embodiment, a proportion of lengths of the first region 500 and the second region 501 with respect to the axial direction is 1:1, but is not limited thereto. However, in order to satisfactorily achieve a developer stirring effect by the gap portions, the first region where the plurality of gap portions where the blade is discontinuous are provided in one pitch may preferably be disposed at least one position of the entire region of the screw with respect to the axial direction. That is, the first region including two or more gap portions in one pitch may preferably be disposed at one position or at a plurality of positions. In the case where a plurality of first regions are provided, the first regions may exist continuously or may exist discontinuously. For example, the first regions including the gap portions every pitch and the second regions including no gap portions may also be disposed so as to alternately exist.

Further, even in the case where the first region is continuous over a plurality of pitches, such a region may also be disposed, as described above, at an appropriate position such as a downstream half portion or a central portion, other than an upstream half portion of the second screw 46A. However, at least one gap portion may preferably exist on at least a side upstream of the toner content sensor 49 with respect to the feeding direction of the second screw 46A.

Other Embodiments

In the above-described embodiments, as shown in FIG. 9, the constitution in which the gap portions 46*g* of the blade 46*c* repetitively exist every 90° was described. However, phases of the blade and the gap portions may also be those other than the above-described phases. For example, in a second screw 46B as a first example shown in FIG. 14, a constitution in which blades 46Bc and gap portions 46Bg are periodically repeated every 45° may also be employed.

Figure 14:
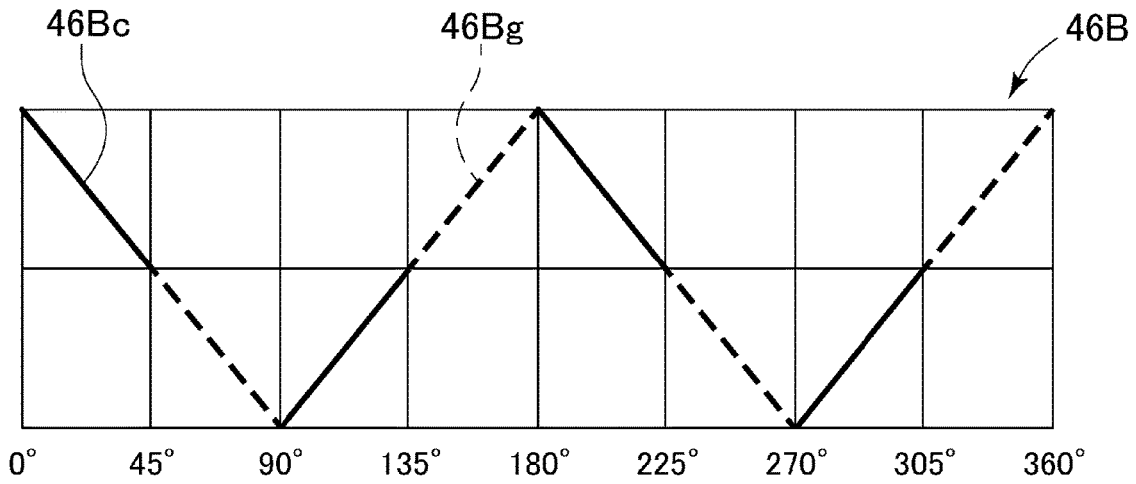
FIG. 14 is a schematic view showing a phase of a second blade of a second screw according to a first example of another embodiment.
Figure 15:
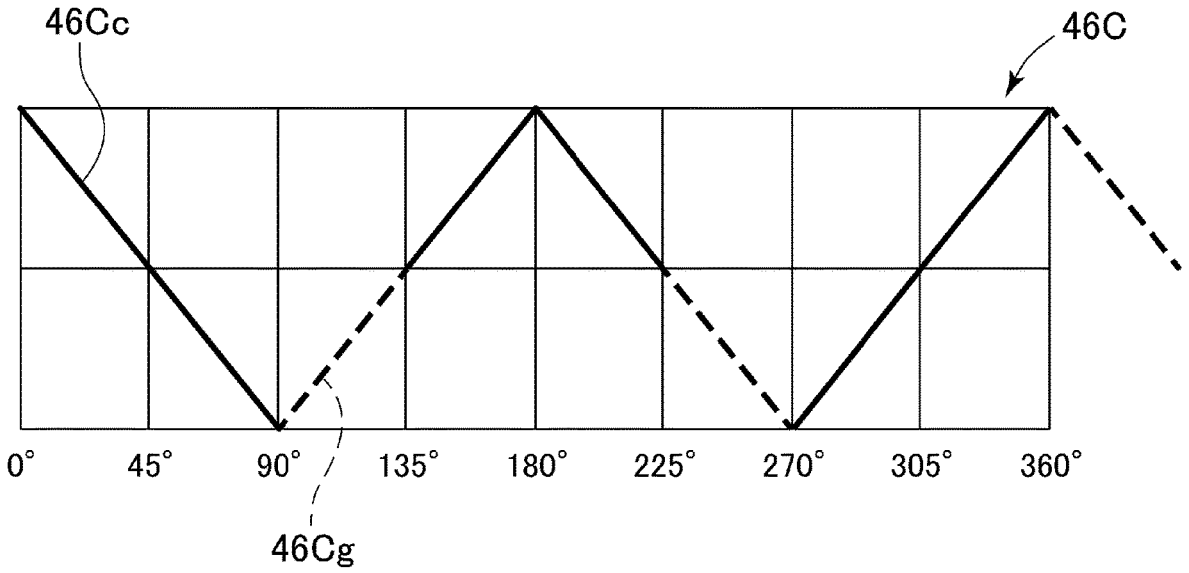
FIG. 15 is a schematic view showing a phase of a second blade of a second screw according to a second example of another embodiment.

Further, the blades and the gap portions may also be not disposed periodically, and for example, the blades and the gap portions may also be disposed in combination every arbitrary phase. For example, as in a second screw 46C as a second example shown in FIG. 15, blades 46Cc and gap portions 46Cg may also appear at a different proportion. In FIG. 15, the case where the blades 46Cc appear with the phase of 90°, and the gap portions 46Cg appear with the phase of 45° is shown. FIGS. 14 and 15 schematically illustrate, similarly as in FIG. 9, the phases of the second screws 46B and 46C by paying attention to only the blades 46Bc and 46Cc, respectively.

In the above-described embodiments, the three-thread screw was described as the screw including the plurality of blades (threads), but the present invention is also applicable to a two-thread screw or four or more—thread screw when a relationship between the gap portions and the blades is the above-described relationship. Further, the blade (thread) provided with the gap portions may only be required to be not less than the single blade (thread), and for example, in the case of the three-thread screw, a constitution in which the single blade (thread) is formed in a continuous shape over the entire region with respect to the axial direction and the remaining two blades (threads) are provided with the above-described gap portions may also be employed.

The gap portions described in the above-described embodiments may only be required to be portions where the blade is discontinuous, and for example, between the adjacent portions of the blade 46*c* with respect to a direction along a helix in FIG. 8, a blade having an outer diameter smaller than the outer diameter of the blade 46*c* may also exist. That is, a part of an outer peripheral surface of the blade continuous in the axial direction is cut away at a part of the axial direction, and this cut-away portion may also be used as the gap portion. In summary, the present invention also includes the case such that a blade-free portion where components of a flow of the developer generate along the feeding direction and the stirring direction at a part of the blade with respect to the axial direction corresponds to the gap portion, and the gap portion includes not only the case where the blade is completely removed but also the case where the blade partly remains.

In the above-described embodiments, the constitution in which the image forming apparatus was the printer was described, but the present invention is also applicable to a copying machine, a facsimile machine, a multi-function machine and the like. Further, in the above-described embodiments, as the developing device, the constitution in which the developer is supplied from the developing chamber to the developing sleeve and is collected from the developing sleeve into the developing chamber was described. However, the present invention is also applicable to a constitution in which the developer is supplied from the developing chamber (first chamber) and is collected in the stirring chamber (second chamber) provided while sandwiching the partition wall between itself and the developing chamber. Further, other than the developing device in which the first chamber and the second chamber are disposed and arranged in the horizontal direction, the present invention is applicable to constitutions such that the first chamber and the second chamber exist in a positional relationship that the first chamber and the second chamber are disposed along an up-down direction or are disposed so as to be inclined with respect to the horizontal direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-100860 filed on May 22, 2017, which is hereby incorporated by reference herein in its entirety.

What is claimed is:

1. A feeding screw for feeding a developer comprising:

a rotation shaft;

a first blade portion helically formed on an outer peripheral surface of said rotation shaft and configured to feed the developer in one direction;

a second blade portion helically formed on the outer peripheral surface of said rotation shaft and configured to feed the developer in the one direction; and a third blade portion helically formed on the outer peripheral surface of said rotation shaft and configured to feed the developer in the one direction, wherein said first blade portion and said second blade portion overlap with each other when viewed along a rotational axis direction of said feeding screw, said second blade portion and said third blade portion do not overlap with each other when viewed along the rotational axis direction of said feeding screw, and said third blade portion and said first blade portion overlap with each other when viewed along the rotational axis direction of said feeding screw, wherein a gap is provided between a downstream end of said second blade in the one direction and an upstream end of said third blade portion in the one direction when viewed along the rotational axis direction of said feeding screw, and said gap is disposed within a region where said first blade portion is formed when viewed along the rotational axis direction of said feeding screw.

2. A feeding screw according to claim 1, wherein said first blade portion and said second blade portion overlap with each other when viewed in a direction perpendicular to the rotational axis of said feeding screw, said second blade portion and said third blade portion do not overlap with each other when viewed in the direction perpendicular to the rotational axis of said second feeding screw, and said third blade portion and said first blade portion overlap with each other when viewed in the direction perpendicular to the rotational axis of said second feeding screw.

3. A feeding screw according to claim 1, wherein an outer diameter of said second blade portion and an outer diameter of said third blade portion are equal to each other.

4. A feeding screw according to claim 1, wherein an outer diameter of said first blade portion, an outer diameter of said second blade portion, and an outer diameter of said third blade portion are equal to each other.

5. A feeding screw according to claim 1, wherein a pitch of said second blade portion and a pitch of said third blade portion are equal to each other.

6. A feeding screw according to claim 1, wherein a pitch of said first blade portion, a pitch of said second blade portion, and a pitch of said third blade portion are equal to each other.

7. A developing device, comprising:

a developer carrying member configured to carry a developer containing toner and a carrier in order to develop an electrostatic latent image formed on an image bearing member;

a developing container including a first chamber configured to supply the developer to said developer carrying member, a second chamber partitioned from said first chamber by a partition wall, a first communication portion configured to permit communication of the developer from said first chamber to said second chamber, and a second communication portion configured to permit communication of the developer from said second chamber to said first chamber;

a first feeding screw provided in said first chamber and configured to feed the developer in a first direction from said second communication portion to said first communication portion; and a second feeding screw provided in said second chamber and configured to feed the developer in a second direction from said first communication portion to said second communication portion;

wherein said second feeding screw includes, a rotation shaft, a first blade portion helically formed on an outer peripheral surface of said rotation shaft and configured to feed the developer in the second direction, a second blade portion helically formed on the outer peripheral surface of said rotation shaft and configured to feed the developer in the second direction, and a third blade portion helically formed on the outer peripheral surface of said rotation shaft and configured to feed the developer in the second direction, wherein said first blade portion and said second blade portion overlap with each other when viewed along a rotational axis direction of said second feeding screw, said second blade portion and said third blade portion do not overlap with each other when viewed along the rotational axis direction of said second feeding screw, and said third blade portion and said first blade portion overlap with each other when viewed along the rotational axis direction of said second feeding screw, wherein a gap is provided between a downstream end of said second blade in the second direction and an upstream end of said third blade portion in the second direction when viewed along the rotational axis direction of said second feeding screw, and said gap is disposed within a region where said first blade portion is formed when viewed along the rotational axis direction of said second feeding screw.

8. A developing device according to claim 7, wherein said first blade portion and said second blade portion overlap with each other when viewed in a direction perpendicular to the rotational axis of said second feeding screw, said second blade portion and said third blade portion do not overlap with each other when viewed in the direction perpendicular to the rotational axis of said second feeding screw, and said third blade portion and said first blade portion overlap with each other when viewed in the direction perpendicular to the rotational axis of said second feeding screw.

9. A developing device according to claim 7, wherein an outer diameter of said second blade portion and an outer diameter of said third blade portion are equal to each other.

10. A developing device according to claim 7, wherein an outer diameter of said first blade portion, an outer diameter of said second blade portion, and an outer diameter of said third blade portion are equal to each other.

11. A developing device according to claim 7, wherein a pitch of said second blade portion and a pitch of said third blade portion are equal to each other.

12. A developing device according to claim 7, wherein a pitch of said first blade portion, a pitch of said second blade portion, and a pitch of said third blade portion are equal to each other.

13. A developing device according to claim 7, further comprising a developer supplying portion provided in said second chamber and configured to supply the developer into said developing container, wherein with respect to the second direction, said second blade portion is provided downstream of said developer supplying portion, and wherein with respect to the second direction, said third blade portion is provided downstream of said developer supplying portion.

14. A developing device according to claim 7, further comprising a toner content detecting portion provided in said second chamber and configured to detect a toner content of the developer in said developing container, wherein with respect to the second direction, said second blade portion is provided upstream of said toner content detecting portion, and wherein with respect to the second direction, said third blade portion is provided upstream of said toner content detecting portion.

15. A developing device according to claim 7, further comprising, a developer supplying portion provided in said second chamber and configured to supply the developer into said developing container, and a toner content detecting portion provided in said second chamber and configured to detect a toner content of the developer in said developing container, wherein with respect to the second direction, said second blade portion is provided downstream of said developer supplying portion and upstream of said toner content detecting portion, and wherein with respect to the second direction, said third blade portion is provided downstream of said developer supplying portion and upstream of said toner content detecting portion.

* * * * *